US011768464B2

(12) United States Patent
Christan

(10) Patent No.: US 11,768,464 B2
(45) Date of Patent: Sep. 26, 2023

(54) HOROLOGICAL TORQUE LIMITING MECHANISM

(71) Applicant: ETA SA Manufacture Horlogere Suisse, Grenchen (CH)

(72) Inventor: Julien Christan, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 877 days.

(21) Appl. No.: 16/805,904

(22) Filed: Mar. 2, 2020

(65) Prior Publication Data

US 2020/0285196 A1 Sep. 10, 2020

(30) Foreign Application Priority Data

Mar. 5, 2019 (EP) ..... 19160841

(51) Int. Cl.
*G04B 3/10* (2006.01)
*G04B 13/02* (2006.01)

(52) U.S. Cl.
CPC ..... *G04B 3/10* (2013.01); *G04B 13/023* (2013.01)

(58) Field of Classification Search
CPC ..... G04B 27/02; G04B 27/04; G04B 3/10; G04B 13/021–025
See application file for complete search history.

(56) References Cited

U.S. PATENT DOCUMENTS 7,287,901 B1 * 10/2007 Helfer ..... G04B 13/005 368/207
2007/0237035 A1 * 10/2007 Helfer ..... F16D 41/069 368/147
2012/0186054 A1 * 7/2012 Cusin ..... G04B 15/14 29/225

(Continued)

FOREIGN PATENT DOCUMENTS

CH 703 483 A2 1/2012
EP 1 843 225 A1 10/2007

(Continued)

OTHER PUBLICATIONS

European Search Report dated Aug. 9, 2019 in European Application 19160841.3 filed on Mar. 5, 2019 (with English Translation of Categories of Documents Cited & Written Opinion), 7 pages.

*Primary Examiner* — Daniel P Wicklund
(74) *Attorney, Agent, or Firm* — Oblon, McClelland, Maier & Neustadt, L.L.P.

(57) ABSTRACT

A horological torque limiting mechanism, including a first wheel with a first elastic arm projecting from a first felloe, a second wheel including a second surface to engage in frictional pressure with the first wheel for the relative actuation thereof, a travel limiter fastened to a structure to hold the first and second wheels in frictional pressure in certain angular positions, the second wheel and/or the travel limiter and/or the structure including a relief forming a ramp, to, in certain angular positions relative to the first wheel, engage in frictional pressure with the first elastic arm, (Continued)

and, in further positions, allow a frictionless travel between the first wheel and the component bearing the relief, the second wheel includes a second arm forming a ramp projecting from a second felloe.

21 Claims, 8 Drawing Sheets

(56) References Cited

U.S. PATENT DOCUMENTS

| | | | | |
|---|---|---|---|---|
| 2015/0124569 | A1* | 5/2015 | Decosterd | G04B 1/20 368/127 |
| 2020/0192295 | A1* | 6/2020 | Rochat | F16D 7/021 |
| 2020/0285196 | A1* | 9/2020 | Christan | G04B 13/023 |
| 2021/0063967 | A1* | 3/2021 | Comment | G04B 15/14 |
| 2021/0349423 | A1* | 11/2021 | Saglini | G04B 11/003 |

FOREIGN PATENT DOCUMENTS

| | | | |
|---|---|---|---|
| EP | 2 871 534 | A1 | 5/2015 |
| FR | 1 207 713 | A | 2/1960 |

* cited by examiner

HOROLOGICAL TORQUE LIMITING MECHANISM

CROSS-REFERENCE TO RELATED APPLICATION

This application claims priority to European Patent Application No. 19160841.3 filed on Mar. 5, 2019, the entire disclosure of which is hereby incorporated herein by reference.

FIELD OF THE INVENTION

The invention relates to an internal torque limiting mechanism for a horological movement, said torque limiting mechanism including a first wheel including a first felloe and arranged to pivot about a first axis of rotation relative to a structure or a plate or a bridge, said first wheel including at least a first elastic arm which, in the free state of said first wheel, projects along the direction of said first axis of rotation relative to said first felloe, and at least a second wheel including a second felloe and arranged to pivot relative to said structure about a second axis of rotation parallel or merged with said first axis of rotation overlapping at least partially with said first wheel.

The invention further relates to a barrel winding device including a control member arranged to be operated by a user and to actuate an input pinion engaging with said first wheel or said second wheel of such a torque limiting mechanism, included in said device.

The invention further relates to a horological movement including, between an input mechanism and an output mechanism, such a torque limiting mechanism.

The invention further relates to a timepiece, particularly a watch, including at least such a torque limiting mechanism, and/or at least such a movement.

The invention relates to the field of horological mechanisms, and more particularly the protection of certain mechanisms against an excessive torque addition, in particular energy recharging mechanisms such as winding mechanisms, or correction and/or display mechanisms, in particularly calendar or similar mechanisms.

BACKGROUND OF THE INVENTION

Some horological mechanisms are designed to store and restore large quantities of energy, however, the dimensioning thereof is limited by that of the case of the timepiece in question, and it is not possible to apply high safety coefficients thereto to protect same against an excessive torque that might be applied thereto. The large size of known torque limiting mechanisms restricts the integration of complications in the timepiece. In addition, the user does not have the option of knowing whether they have correctly performed, completely safely, a complete setting, in particular for winding a mechanism.

The document CH703483A2 held by SEIKO describes a wheel with a torque limiting mechanism comprising a penetration arm part extending from a proximal end part to a distal end part equipped with a penetration addendum, which is engaged elastically in a pressure-engaged part. The addendum is detached from the engaged part to rotate the crown wheels when a torque exceeding a threshold value is applied. A force directed from the proximal end part to the distal end part is applied to the projection when a manual winding torque is applied to the mechanism and suitable for separating the projection from the engaged part.

SUMMARY OF THE INVENTION

The invention proposes to produce a very compact, economical, torque limiting device, the use whereof enables the user to determine readily the proper completion of a setting by said user.

For this purpose, the invention relates to an internal torque limiting mechanism for a horological movement, according to claim 1, The invention further relates to a barrel winding device including such a torque limiting mechanism.

The invention further relates to a horological movement including, between an input mechanism and an output mechanism, such a torque limiting mechanism.

The invention further relates to a timepiece, particularly a watch, including at least such a torque limiting mechanism, and/or at least such a movement.

BRIEF DESCRIPTION OF THE DRAWINGS

Further features and advantages of the invention will emerge on reading the following detailed description, with reference to the appended drawings, wherein:

FIG. 1 represents, schematically, and in a perspective view, a torque limiting mechanism according to the invention, including a first upper wheel and a second lower wheel, which are held in frictional engagement, at the level of the elastic arms included in each thereof, by an upper travel limiter herein consisting of a shoulder screw, and by a lower structure herein consisting of a bridge or similar;

DETAILED DESCRIPTION OF PREFERRED EMBODIMENTS

Figure 1:
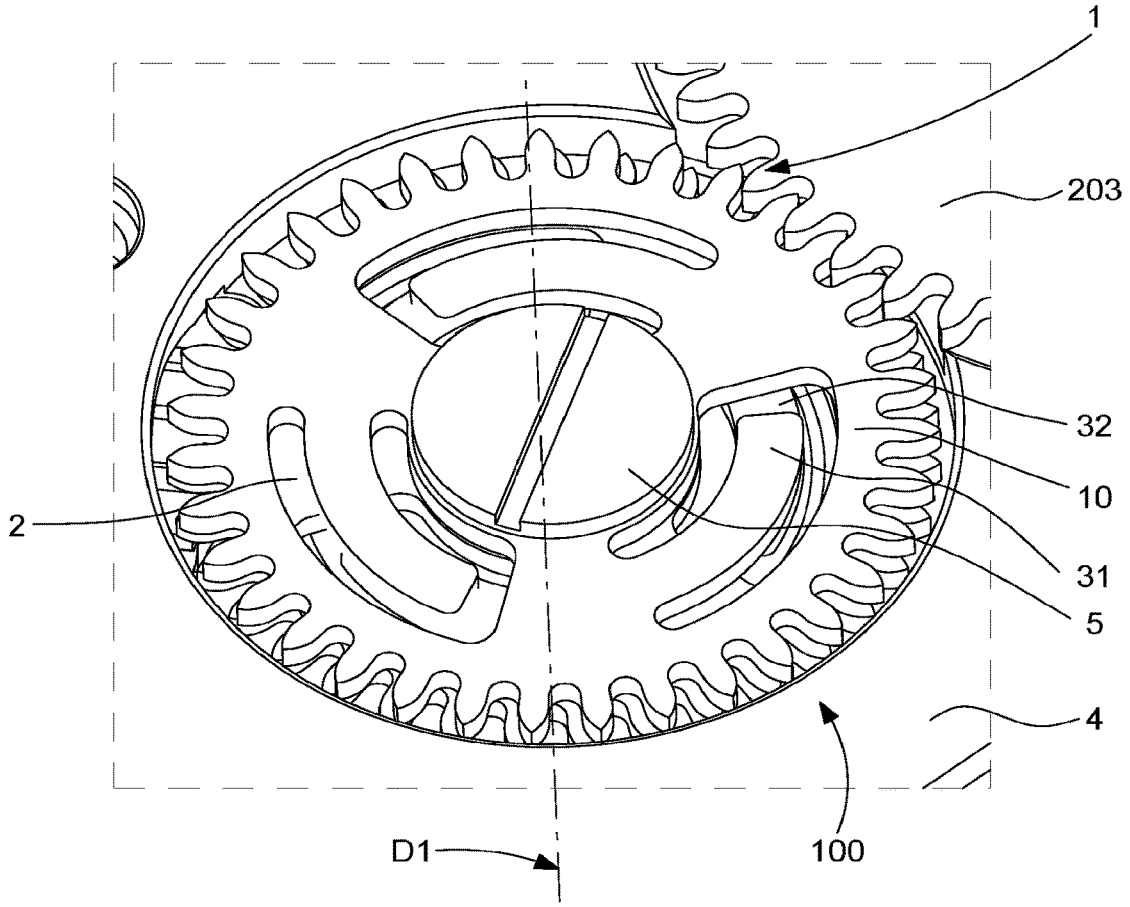
Figure 2:
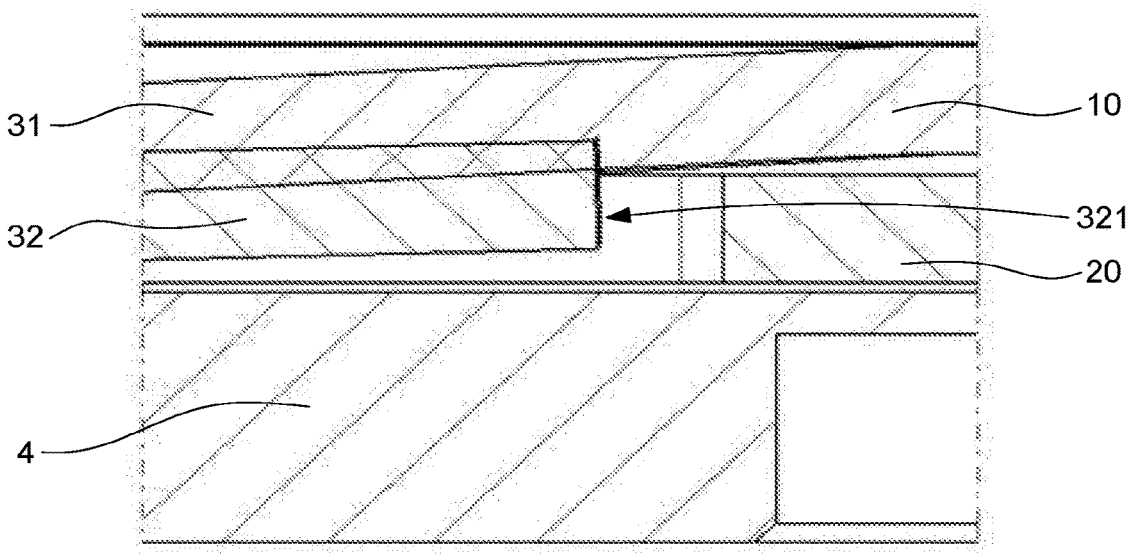
FIG. 2 represents, schematically and in a cross-sectional view, the engagement of the elastic arms of the two wheels in FIG. 1.
Figure 3:
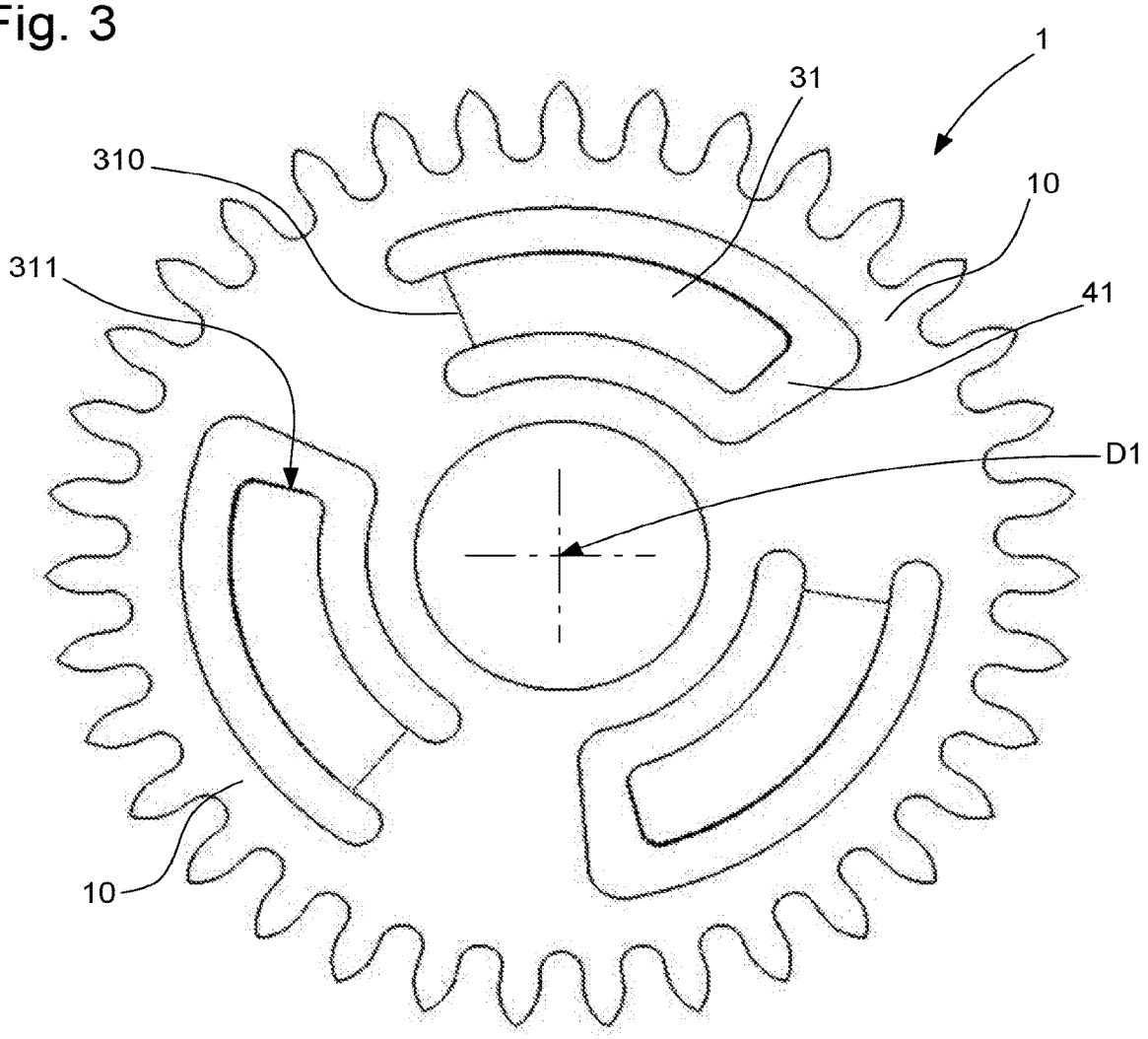
FIG. 3 represents, schematically and in a top view, the first wheel in FIG. 1.
Figure 4:
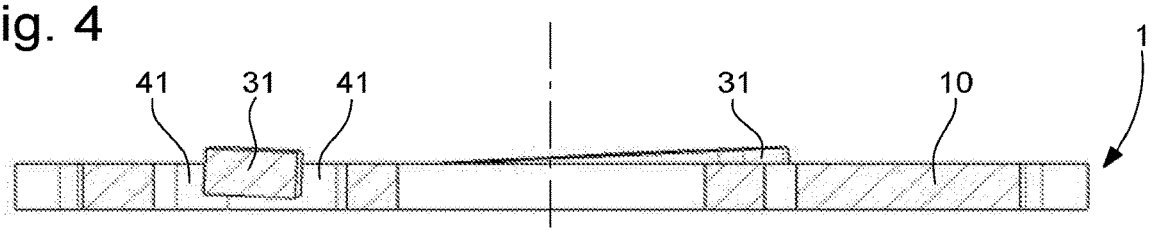
FIG. 4 represents, schematically and in a diametrical cross-sectional view, the wheel in FIG. 3.
Figure 5:
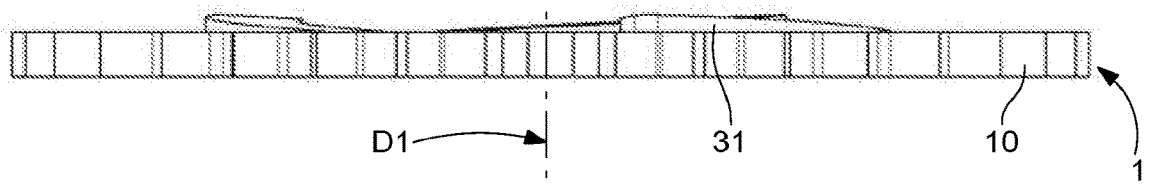
FIG. 5 represents, schematically and in a side view, in the free state, the wheel in FIG. 3.

The invention relates to a horological torque limiting mechanism 100. This mechanism 100 includes a first wheel 1, which includes a first felloe 10 and is arranged to pivot about a first axis of rotation D1 relative to a structure 4 or a plate or a bridge.

This first wheel 1 includes at least a first elastic arm 31, which, in the free state of the first wheel 1, projects along the direction of the first axis of rotation D1 relative to the first felloe 10. More particularly and non-exhaustively, this first elastic arm 31 is movable in a first pressed section 41 of the first wheel 1.

The mechanism 100 includes at least a second wheel 2, which includes a second felloe 20 and arranged to pivot relative to the structure 4 about a second axis of rotation D2, parallel or merged with the first axis of rotation D1, overlapping at least partially with the first.

The mechanism 100 includes a travel limiter 5, which is fastened to the structure 4, and which is arranged to hold the second wheel 2 on the first wheel 1 for the engagement thereof in frictional pressure in certain relative angular positions.

The invention is herein more particularly described in the simplified case where the mechanism 100 merely includes the first wheel 1 and the second wheel 2, those skilled in the art would be able to extrapolate to a greater number of wheels, for a mechanism including more than one input and one output.

The invention proposes to vary the frictional pressure between the first wheel 1 and the second wheel 2.

For this purpose, the second wheel 2 and/or the travel limiter 5 and/or the structure 4 includes at least one relief forming a ramp, and which projects along a direction parallel or merged with that of the first axis of rotation D1. This relief is arranged, in certain relative angular positions of the component bearing this relief relative to the first wheel 1, to engage in frictional pressure with at least a first elastic arm 31 of said first wheel 1, and, in further relative angular positions, allow a frictionless relative travel between the first wheel 1 and the component bearing this relief.

When the structure 4 or the travel limiter 5 includes such a relief, the mechanism forms a simple pawl, arranged to vary the axial position of the first elastic arm of the first wheel 1, or to vary the axial position of the entire first wheel 1 and thus vary the frictional pressure applied on the second wheel 2.

The invention relates more particularly to the case where the second wheel 2 includes at least a second arm 32 forming a ramp and which, in the free state of the second wheel 2, projects along the direction of the second axis of rotation D2 relative to the second felloe 20.

More particularly, this second arm 32 is a second elastic arm 32. Even more particularly, this second arm 32 is a second elastic arm 32 movable in a second pressed section 42.

When only the first wheel 1 and the second wheel 2 include reliefs projecting relative to the respective felloe thereof, they are mounted top-to-tail, with each first elastic arm 31 projecting towards the second wheel 2, and with said second arm 32 projecting towards the first wheel 1.

Figure 16:
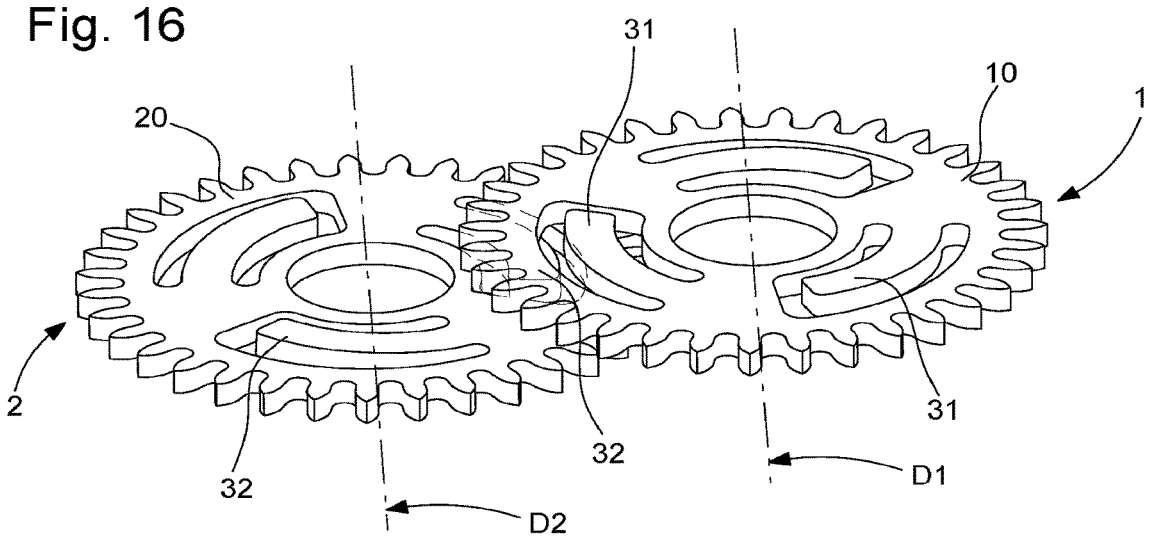
FIG. 16 represents, schematically and in a perspective view, an alternative embodiment where the first wheel and the second wheel are not coaxial.

In an alternative embodiment and as seen in FIG. 16, the second axis of rotation D2 is at a distance from the first axis of rotation D1.

In a further alternative embodiment and as seen in most of the other figures, the second axis of rotation D2 is merged with the first axis of rotation D1.

More particularly, each second arm 32 is arranged to engage successively, upon a relative rotation of the second wheel 2 relative to the first wheel 1, cyclically with the first felloe 10, a first elastic arm 31, and a first pressed section 41 before returning in engagement with the first felloe 10.

It is understood that the first wheel 1 and the second wheel 2 are arranged, if they are coaxial, to rotate in the same direction: either they both rotate in the same direction, or one rotates and the other is locked. These wheels may, in other applications where they are not coaxial, rotate in opposite directions of one another.

Each first elastic arm 31 of the first wheel defines a first ramp, which starts at the level of a hinge 310 with the first felloe 10, and rises to the level of a first apex. More particularly and as seen in the figures, this first elastic arm 31 is an overhanging arm, and the apex is coincident with the distal end of this first arm 31, the edge whereof defines a first front surface 311. In this particular alternative embodiment, any relief of an opposing wheel, in particular the second wheel 2, during a rotation still in the same direction of each wheel, climbs up this first ramp, then drops after passing the apex; according to the configuration, this relief drops onto the first felloe 10, or into the first pressed section 41. This jump corresponds to the disconnection of the mechanism.

In further alternative embodiments not illustrated, the first elastic arm 31 includes an upward ramp from the first felloe 10 to the first apex, then a downward ramp from the first apex to the first felloe 10. In the same way, the relief of the second wheel 2 may be formed in different manners, the figures represent this relief in the form of a second elastic arm 32 similar to the first elastic arm 31 of the first wheel 1, this configuration is advantageous as it makes it possible to use, for this first wheel 1 and the second wheel 2, identical components, at least at the level of these reliefs engaging with one another; obviously, according to the application, the first wheel 1 and the second wheel 2 may include different toothings, according to the components of the movement with which they engage.

More particularly, each first elastic arm 31 is arranged to engage successively, upon a relative rotation of the second wheel 2 relative to the first wheel 1, with the second felloe 20, a second arm 32, and a second pressed section 42 included in the second wheel 2, before returning in engagement with the second felloe 20.

The arrangement with a first front surface 311, and a similar second front surface 312 for the second elastic arm, enables, in a particular direction of rotation, engagement abutting with one another, and rotational actuation by mere, frictionless, pressure of a wheel with another, whereas, in the opposite direction of rotation, the elastic arms engage progressively to an unclicking position where one of the wheels is no longer actuated by the other.

In a particular alternative embodiment illustrated by the figures, each first elastic arm 31 is a substantially annular sector which extends substantially concentrically relative to the first axis of rotation D1. The radial cross-section thereof may be constant, or indeed progressive or degressive, so as to obtain a variable friction according to the relative angle between the opposing wheels. Preferably, the top surface of the first elastic arm 31 extends, radially relative to the first axis of rotation D1, perpendicularly thereto. In a non-illustrated alternative embodiment, this first elastic arm 31 may, further, be warped or slanted. Each second elastic arm 32 may be formed in a similar fashion. And in particular, more particularly, each second elastic arm 32 extends substantially concentrically relative to the second axis of rotation D2.

Figure 19:
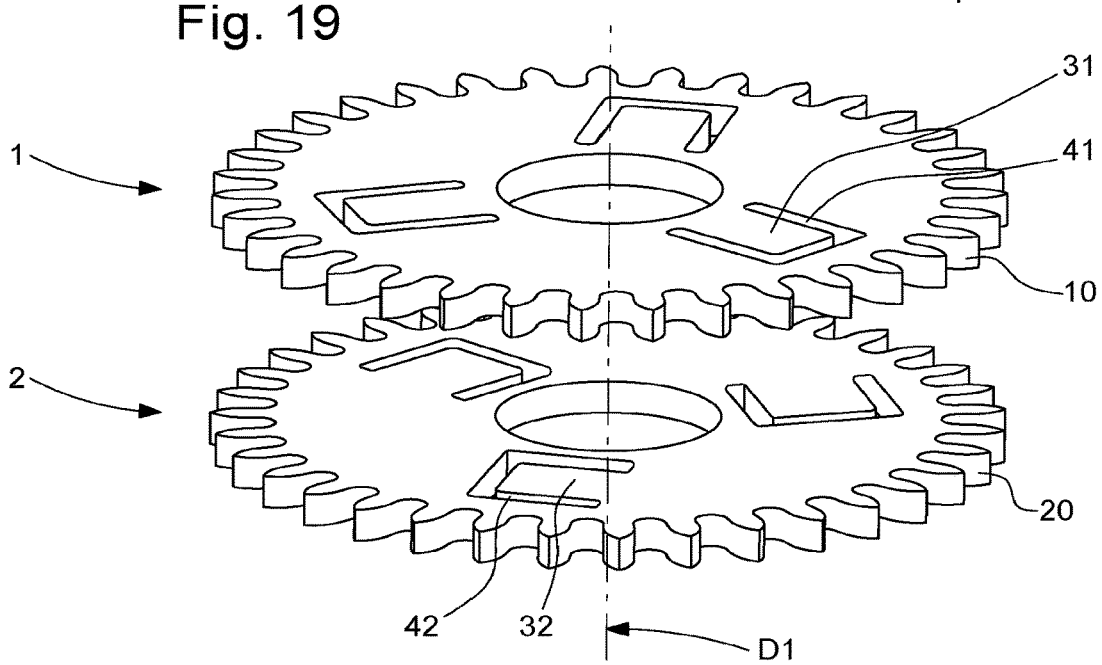
FIG. 19 represents, schematically and in an exploded perspective view, an alternative embodiment where the torque limiting mechanism includes two different wheels, one including elastic arms in a circular arc shape, the other with radial elastic arms.
Figure 20:
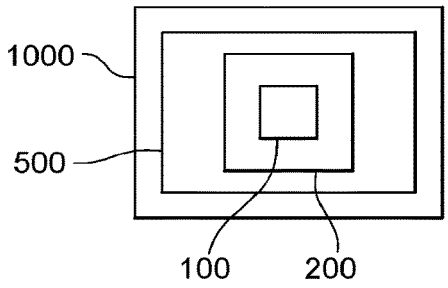
FIG. 20 is a block diagram representing a watch including a movement which includes a barrel winding device, including such a torque limiting device.
Figure 21:
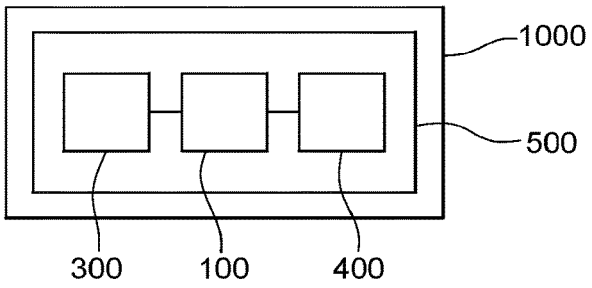
FIG. 21 is a block diagram representing a watch including a movement which includes such a torque limiting mechanism, between an input mechanism and an output mechanism.

In a further alternative embodiment and as seen in FIG. 19, at least a first elastic arm 31 or/and at least a second arm 32 extends substantially radially relative to the axis of rotation of the wheel bearing same.

Figure 17:
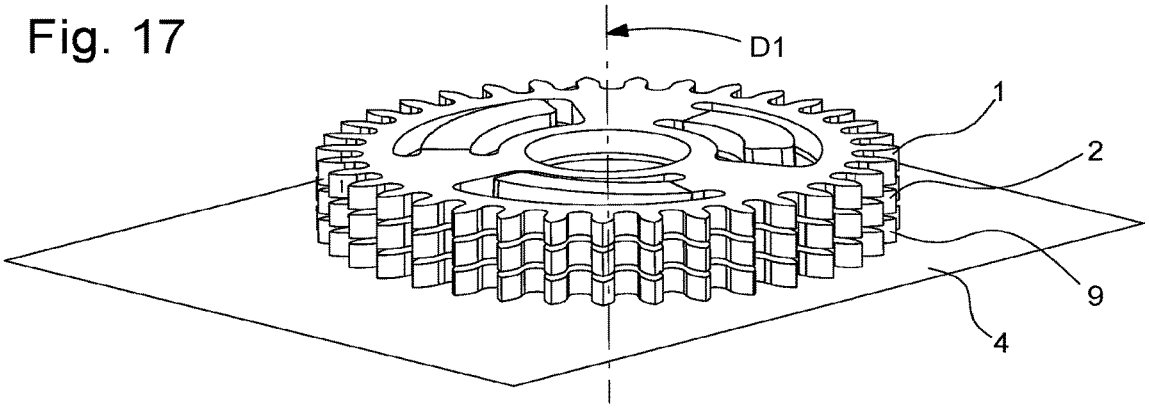
FIG. 17 represents, schematically and in a perspective view, an alternative embodiment where the torque limiting mechanism includes three stacked, coaxial wheels.
Figure 18:
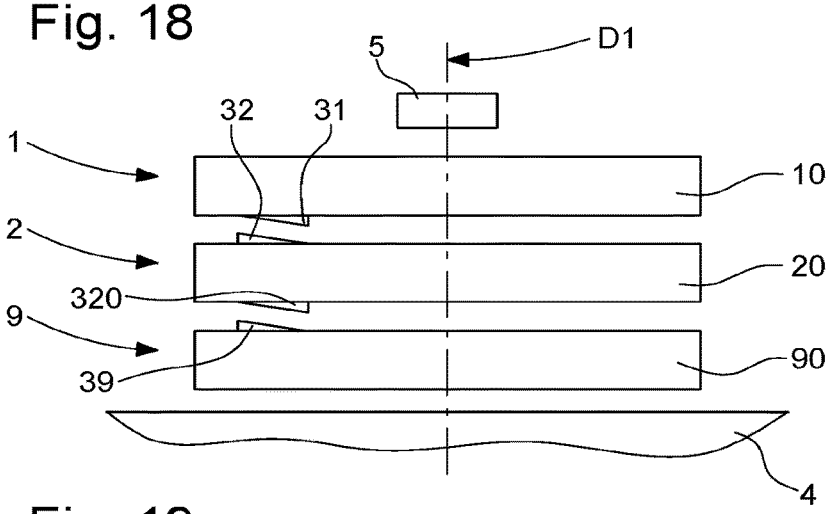
FIG. 18 represents, schematically and in an exploded view, the mechanism in FIG. 17.

More particularly, and as seen in FIGS. 17 and 18, the mechanism 100 includes, at least partially superimposed along a direction parallel with the axis of rotation of each thereof, more than two wheels arranged to engage pairwise in frictional pressure, and all mounted trapped between the structure 4 and the travel limiter 5, and at least one intermediate wheel between the end wheels includes at least one elastic arm projecting from each side of the felloe thereof, along the axial direction thereof: this is the case of the second wheel 2 in FIG. 18, which engages, on the top side of the second felloe 20, with the first wheel 1, and, on the bottom side of the second felloe 20, with the relief 39 projecting from the third felloe 90 of a third wheel 9 pressing on the structure 4.

Figure 6:
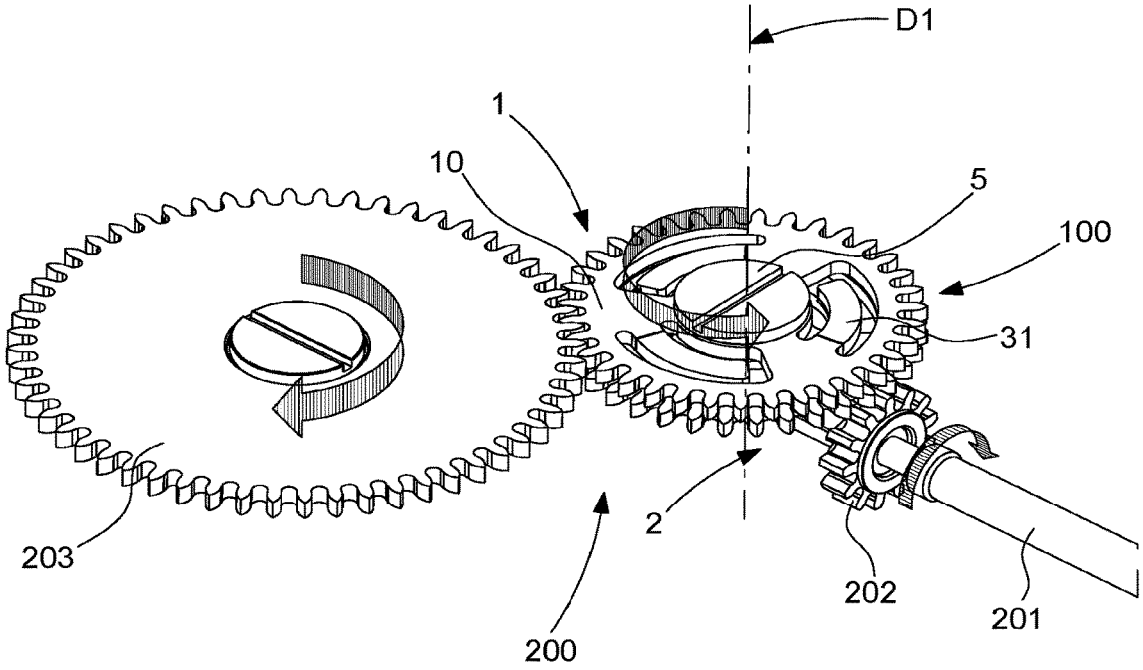
FIG. 6 represents, schematically and in a perspective view, a barrel winding device, including the torque limiting mechanism in FIG. 1, and including a control member, herein consisting of a shaft actuating a winding-mechanism pinion arranged to be operated by a user and to actuate an input pinion engaging with the second wheel, and where the first wheel engages with a barrel ratchet.
Figure 7:
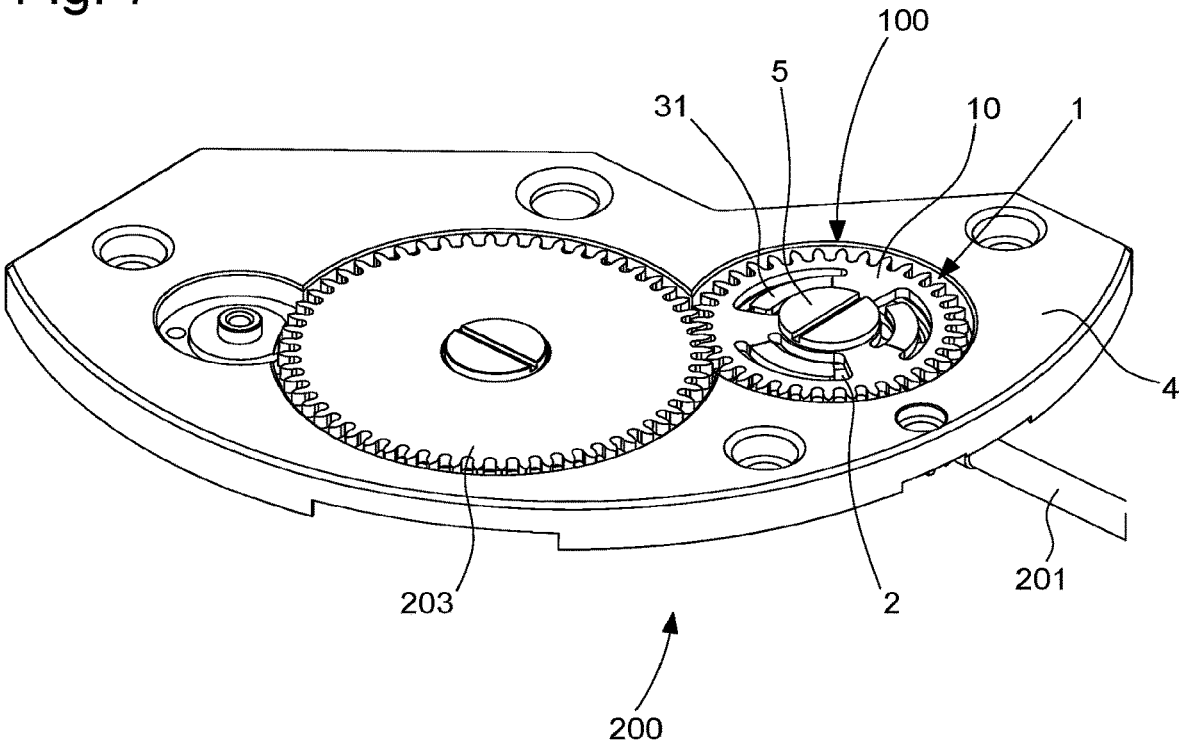
FIG. 7 represents, schematically and in a perspective view, the barrel winding device in FIG. 6 assembled on a barrel bridge whereon the wheels and the ratchet pivot, and which supports the shoulder screw acting as a travel limiter.
Figure 8:
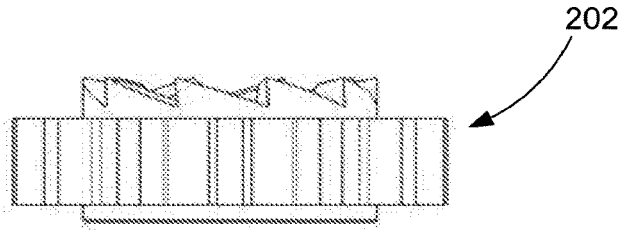
FIG. 8 represents, schematically and in a side view, the wolf-tooth winding-mechanism pinion in FIG. 6.
Figure 9:
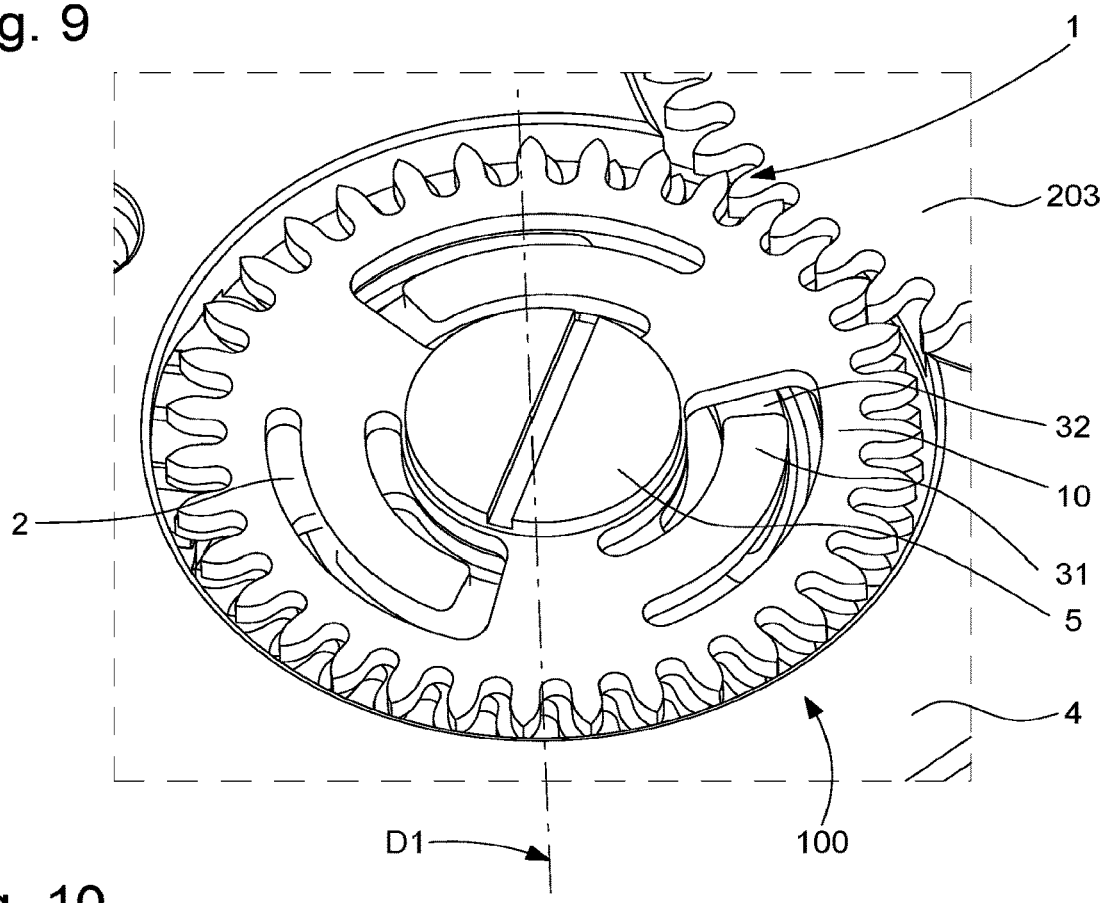
FIGS. 9 and 10 represent, in a similar manner to FIGS. 1 and 2 respectively, the engagement of the first wheel and the second wheel with normal pressure.
Figure 10:
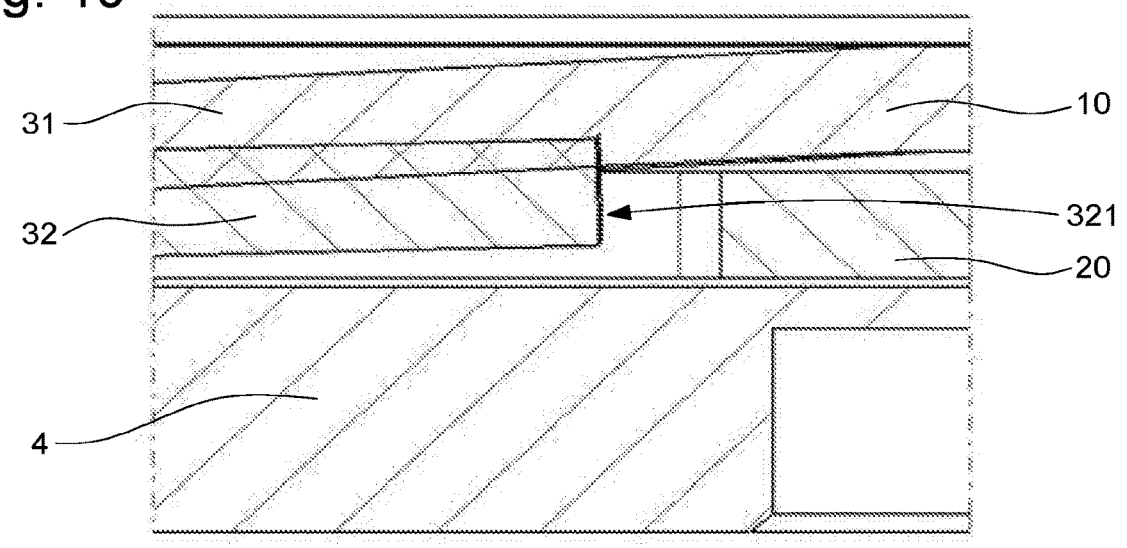
Figure 11:
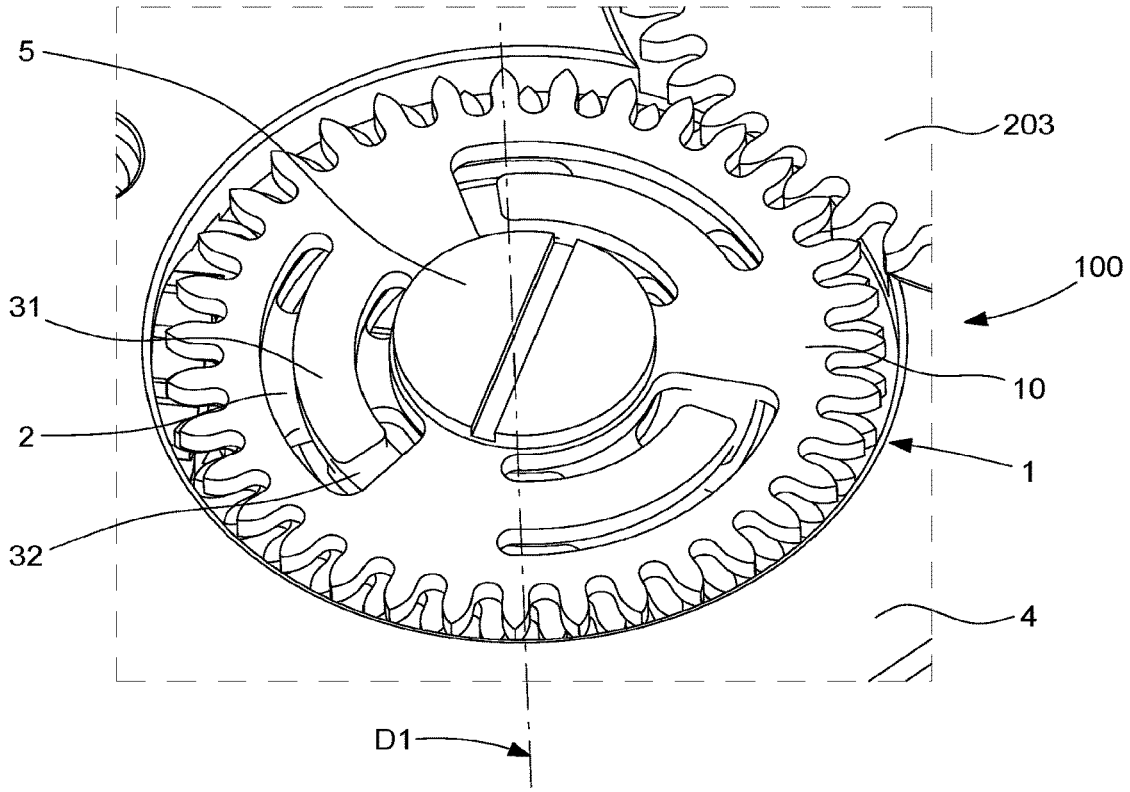
FIGS. 11 and 12 represent, in a similar manner to FIGS. 1 and 2 respectively, the engagement of the first wheel and the second wheel immediately prior to disconnection.
Figure 12:
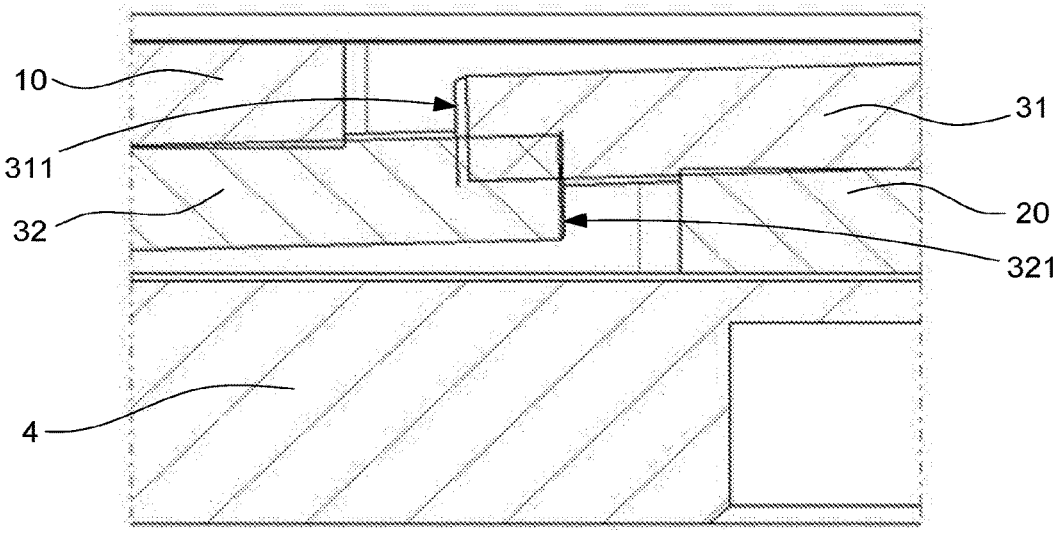
Figure 13:
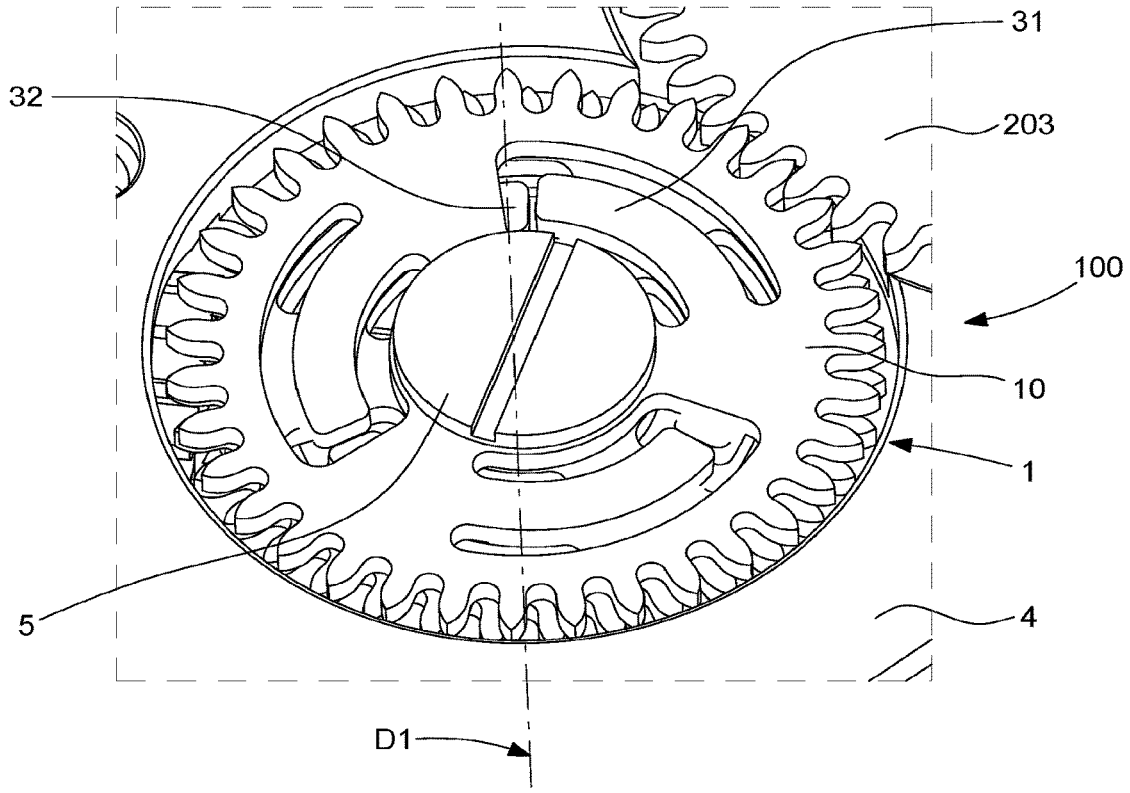
FIGS. 13 and 14 represent, in a similar manner to FIGS. 1 and 2 respectively, the engagement of the first wheel and the second wheel immediately after disconnection.
Figure 14:
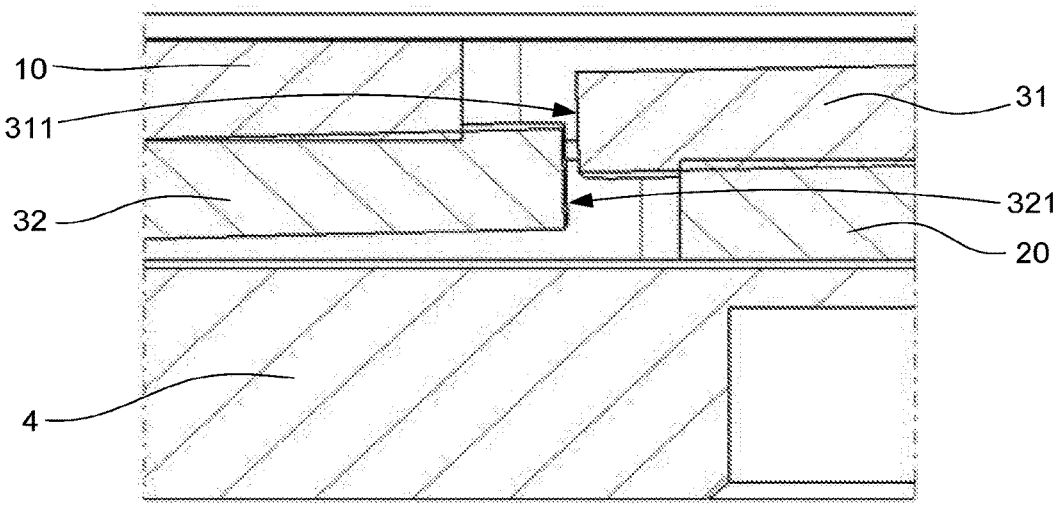
Figure 15:
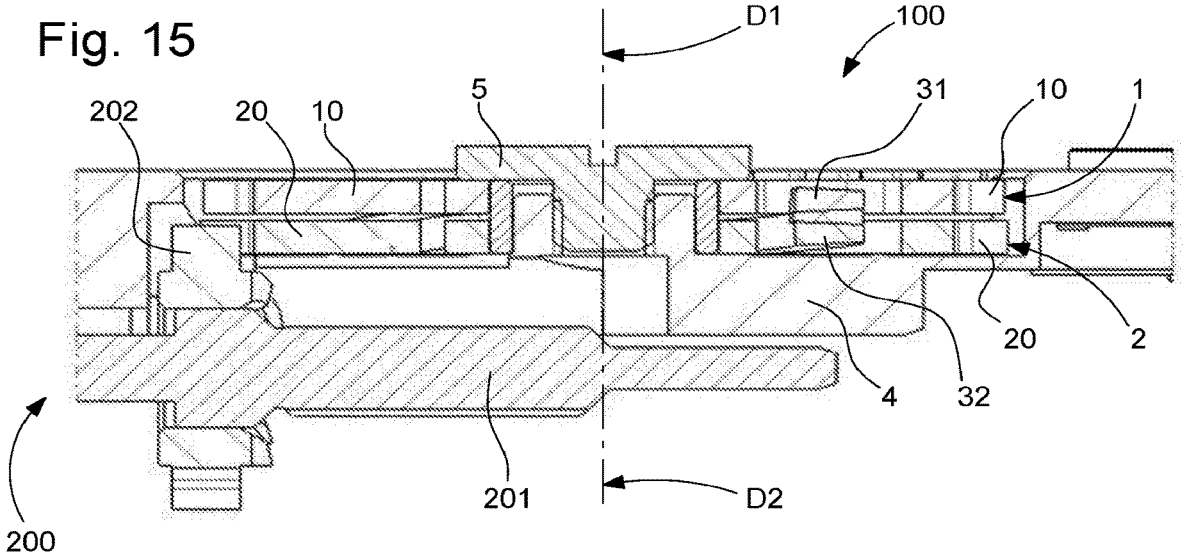
FIG. 15 represents, schematically and in a cross-sectional view, the mechanism in FIG. 7.

As seen in FIGS. 6 and 7, the invention further relates to a barrel winding device 200, including a control member 201 which is arranged to be operated by a user, such as a control shaft, a button, a trigger-piece, a bezel, or similar, to actuate an input pinion 202 engaging with the first wheel 1 or the second wheel 2 of such a torque limiting mechanism 100, included in this device 200. More particularly, the other wheel of this mechanism 100, the second wheel 2 or respectively the first wheel 1, is arranged to actuate a ratchet 203 of a driving or striking-mechanism barrel, the whole being assembled on the structure 4 which is, in this particular case, a barrel bridge. The travel limiter 5 is advantageously a screw fastened to this structure, which facilitates the assembly of the overall mechanism 100 and enables the dismantling thereof.

Thus, particularly and specifically to the invention, the usual crown wheel is split into two plates, forming the first wheel 1 and the second wheel 2, and advantageously in a very economical embodiment, first 31 and second 32 elastic arms are pressed and bent in each thereof. These plates are then mounted top-to-tail in place of the crown wheel. The first wheel 1 engages with a winding-mechanism pinion 202, and the second wheel 2 engages with the barrel ratchet 203. The first wheel 1 and the second wheel 2 are rigidly connected by means of the elastic arms 31 and 32, which transmit a frictional torque. If the torque applied to the winding-mechanism pinion 202 is excessive, the elastic arms 31 and 32 are distorted and slide against one another, until the system disconnects. During disconnection, the jump performed by the elastic arms 31 and 32 during unclicking produces a characteristic noise which gives the user the indication that the barrel is fully recharged.

In the alternative embodiment illustrated by the figures, each wheel 1, 2, includes three elastic arms 31 32. After disconnection, the first wheel 1 performs a third of a turn.

More particularly, the play between the felloes of the two wheels is between 0.06 and 0.10 mm, and the axial elastic travel of each arm is half the value of this play.

The invention further relates to a horological movement 500 including, between an input mechanism 300 and an output mechanism 400, such a torque limiting mechanism 100.

More particularly, the input mechanism 300 is a calendar or date mechanism, and the output mechanism 400 is a mechanism for displaying the month, or day of the week, or date. Also, the torque limiter 100 is arranged to command, upon any jump of an arm of a wheel 1 or 2 of the torque limiter 100, the gain by one step of the display in question. For example, the command to correct the display of the day of the week is a cyclical command for which the device according to the invention is well suited. Similarly, a clear date correction setting may be obtained.

The invention is readily adaptable to any semi-instantaneous or dragging display: months, days, time zones, hours, or others.

The invention is also suitable for producing a reverser for mono- or bidirectional winding: the first wheel 1 engages with an oscillating automatic winding mass, and the second wheel 2 engages with the winding train. When the first wheel 1 turns in the clockwise direction, the system unclicks and the second wheel 2 does not turn. When the first wheel 1 turns in the anticlockwise direction, it actuates the second wheel 2 via the distal ends 311, 321, of the elastic arms 31 and 32. Thus, more particularly, the movement 500 includes an oscillating automatic winding mass and an automatic winding train, and such a torque limiter 100 including elastic arms 31, 32, forms a reverser for mono- or bidirectional winding, the first wheel 1 engaging with the oscillating automatic winding mass, and the second wheel 2 engaging with the winding train, such that, when the first wheel 1 turns in the clockwise, or respectively anticlockwise, direction, the system unclicks and the second wheel 2 does not turn, and when the first wheel 1 turns in the anticlockwise, or respectively clockwise, direction, it actuates the second wheel 2 via distal ends 311,321, included respectively in the elastic arms 31, 32.

The invention is also suitable for producing a brake-lever, for example to prevent a barrel from being discharged. The ratchet may be provided with elastic arms, and the barrel bridge with notches, such that the ends of the arms fall into the notches. Thus, more particularly, the movement 500 includes at least a barrel and a ratchet arranged on a barrel bridge, and such a torque limiter 100 forms a brake-lever, to prevent a barrel from being discharged, the ratchet forming one of the wheels 1, 2, and including elastic arms, and the barrel bridge forming a structure 4 and including notches, such that the ends of the arms fall into the notches.

More particularly, the input mechanism 300 is a minute repeater release mechanism, and the output mechanism 400 is a minute repeater mechanism. The torque limiter 100 is then arranged to command, upon any jump of an arm of a wheel 1 or 2 of the torque limiter 100, the control of a lifting-lever, included in the minute repeater mechanism, to inhibit the command of a further repeater during the execution of a repeater striking-mechanism.

The invention further relates to a timepiece 1000 including at least such a torque limiting mechanism 100, and/or at least such a movement 500. More particularly, this timepiece 1000 is a watch.

In sum, the proposed mechanism is very simple, as it requires no elastic return means other than those borne by the first wheel 1, and preferably the second wheel 2. In particular, it is not necessary to insert, in the space defined by the structure 4 and the travel limiter 5, a spring to press the first wheel 1 and the second wheel 2 against one another.

The coaxial arrangement of the wheels is particularly advantageous, as the pressures exerted on the wheels are symmetrical, and the transmissible pressure is maximal. In the case where the arrangement in the horological movement involves offsetting the first 1 and the second 2 wheels, it is advantageous to increase the number of elastic arms to prevent dead angles.

The embodiment of the wheels may stem, very economically, from stamping, the wheels may be identical, and optionally differ solely by the toothing thereof.

The invention enables the user to ensure that the function performed, winding, display correction, release, is completed properly, and ensures the protection of the components of the mechanism in question against any excessive torque. For example, the user can wind a barrel completely without being concerned about breaking a component.

The invention claimed is:

1. An internal torque limiting mechanism for a horological movement, said torque limiting mechanism comprising:

a first wheel including a first felloe and arranged to pivot about a first axis of rotation relative to a structure or a plate or a bridge, said first wheel including at least a first elastic arm which, in a free state of said first wheel, projects along the direction of said first axis of rotation relative to said first felloe, and at least a second wheel including a second felloe and arranged to pivot relative to said structure about a second axis of rotation parallel or merged with said first axis of rotation overlapping at least partially with said first wheel, where said second wheel includes at least a second surface arranged to engage in frictional pressure with said first wheel for a relative actuation thereof with one another, and a travel limiter fastened to said structure and which is arranged to hold said second wheel on said first wheel for the engagement thereof in frictional pressure in certain relative angular positions, wherein said second wheel includes a second arm forming a ramp and which, in a free state of said second wheel, projects along the direction of said second axis of rotation relative to said second felloe, said ramp being arranged to, in certain relative angular positions with respect to said first wheel, engage in frictional pressure with at least said first elastic arm of said first wheel, and, in further relative angular positions, allow a frictionless relative travel between said first wheel and the second wheel.

2. The mechanism according to claim 1, wherein at least said first elastic arm is movable in a first pressed section of said first felloe.

3. The mechanism according to claim 2, wherein each said second arm is arranged to engage successively, upon a relative rotation of said second wheel relative to said first wheel, with said first felloe, said first elastic arm, and said first pressed section before returning in engagement with said first felloe.

4. The mechanism according to claim 1, wherein said second arm is a second elastic arm.

5. The mechanism according to claim 1, wherein at least said second arm is movable in a second pressed section of said second felloe.

6. The mechanism according to claim 5, wherein each said first elastic arm is arranged to engage successively, upon a relative rotation of said second wheel relative to said first wheel, with said second felloe, said second arm, and said second pressed section included in said second wheel, before returning in engagement with said second felloe.

7. The mechanism according to claim 1, wherein said first wheel and said second wheel are mounted top-to-tail, with each said first elastic arm projecting towards said second wheel, and with each said second arm projecting towards said first wheel.

8. The mechanism according to claim 1, wherein said second axis of rotation is at a distance from said first axis of rotation.

9. The mechanism according to claim 1, wherein said second axis of rotation is merged with said first axis of rotation.

10. The mechanism according to claim 1, wherein each said first elastic arm is an annular sector which extends substantially concentrically relative to the first axis of rotation.

11. The mechanism according to claim 1, wherein each said second arm extends substantially concentrically relative to said second axis of rotation.

12. The mechanism according to claim 1, wherein at least a second first elastic arm or/and at least said second arm extends substantially radially relative to the axis of rotation of the wheel bearing same.

13. The mechanism according to claim 1, wherein said mechanism comprises an intermediate wheel between the first wheel and the second wheel, the first wheel, the intermediate wheel, and the second wheel being at least partially superimposed along a direction parallel with the axis of rotation of each thereof, and the first wheel, the intermediate wheel, and the second wheel are all mounted trapped between said structure and said travel limiter, and wherein at least one intermediate wheel includes at least one elastic arm projecting from each side of the felloe thereof, along the axial direction thereof.

14. A barrel winding device comprising a control member arranged to be operated by a user and actuate an input pinion engaging with said first wheel or said second wheel of a torque limiting mechanism according to claim 1, included in said device, of which said second wheel or respectively said first wheel is arranged to actuate a ratchet of a driving or striking-mechanism barrel.

15. An horological movement comprising, between an input mechanism and an output mechanism, a torque limiting mechanism according to claim 1.

16. The movement according to claim 15, wherein said input mechanism is a calendar or date mechanism, and wherein said output mechanism is a mechanism for displaying the month, or day of the week, or date, and wherein said torque limiter is arranged to command, upon any jump of an arm of a wheel of said torque limiter, the gain by one step of the display in question.

17. The movement according to claim 15, wherein said input mechanism is a minute repeater release mechanism, and wherein said output mechanism is a minute repeater mechanism, and wherein said torque limiter is arranged to command, upon any jump of an arm of a wheel of said torque limiter, the control of a lifting-lever, included in said minute repeater mechanism, to inhibit the command of a further repeater during the execution of a repeater striking-mechanism.

18. The movement according to claim 15, wherein movement comprises an oscillating automatic winding mass and an automatic winding train, and wherein said torque limiter forms a reverser for mono- or bidirectional winding, said first wheel engaging with said oscillating automatic winding mass, and said second wheel engaging with the winding train, such that, when said first wheel turns in the clockwise, or respectively anticlockwise, direction, the system unclicks and said second wheel does not turn, and when said first wheel turns in the anticlockwise, or respectively clockwise, direction, it actuates said second wheel via distal ends included in said elastic arms.

19. The movement according to claim 15, wherein said movement comprises at least a barrel and a ratchet arranged on a barrel bridge, and wherein said torque limiter forms a brake-lever, to prevent said barrel from being discharged, said ratchet forming one of said wheels and including elastic arms, and said barrel bridge forming said structure and including notches, such that the ends of said arms fall into said notches.

20. A timepiece comprising at least a movement according to claim 15.

21. The timepiece according to claim 20, wherein said timepiece is a watch.

* * * * *